United States Patent [19]

Kuhl et al.

[11] 4,302,142

[45] Nov. 24, 1981

[54] APPARATUS FOR AUTOMATICALLY LOADING EGGS DIRECTLY FROM STACKS OF EGG-FILLED FLATS

[75] Inventors: Henry Y. Kuhl; Paul R. Kuhl, both of Flemington, N.J.

[73] Assignee: Kuhl Corporation, Flemington, N.J.

[21] Appl. No.: 114,538

[22] Filed: Jan. 23, 1980

[51] Int. Cl.[3] ..... B65G 59/10

[52] U.S. Cl. ..... 414/120; 414/65; 414/118; 414/786

[58] Field of Search ..... 414/65, 66, 118, 120, 414/121, 413, 416, 786

[56] References Cited

U.S. PATENT DOCUMENTS

| | | | |
|---|---|---|---|
| 2,045,292 | 6/1936 | Carey | 414/118 X |
| 2,675,928 | 4/1954 | Slater | 414/65 |
| 3,991,885 | 11/1976 | Warren | 414/416 X |
| 4,164,296 | 8/1979 | Trees | 414/416 |

FOREIGN PATENT DOCUMENTS

| | | | |
|---|---|---|---|
| 505543 | 5/1939 | United Kingdom | 414/416 |

*Primary Examiner*—Robert W. Saifer

*Attorney, Agent, or Firm*—John J. Kane; Frederick A. Zoda; Albert Sperry

[57] ABSTRACT

An apparatus and method for automatically loading eggs directly from stacks of alternately rotatably oriented flats includes a conveyor for supplying stacks of eggs to an egg loading station which includes a device for removing of the eggs from the uppermost flat and for removing the uppermost now empty flat. The device includes a device for rotating and lifting the stack after the flat is removed to orient the stack for the removing of the next layer of eggs. Such a configuration is made necessary since such stacks of eggs are normally arranged with each layer of eggs being rotated 90° with respect to the next layer of eggs and since the array of eggs is normally not square it is necessary to reorient the stack each time a layer of eggs and the associated flat is removed therefrom. For this reason the present invention includes a stack rotation device in addition to a flat removal device, an egg removal device and a stack supply means.

16 Claims, 3 Drawing Figures

APPARATUS FOR AUTOMATICALLY LOADING EGGS DIRECTLY FROM STACKS OF EGG-FILLED FLATS

BACKGROUND OF THE INVENTION

1. Field of the Invention

The present invention deals with the field of processing equipment for the transfer of eggs from crates, dollies or other holding and transporting units to the infeed of continuous type egg washers, egg candlers, egg graders, or other egg handling and conveying units. It is necessary to withdraw these eggs from crates as they are arranged normally in six high stacks of flats and orient the eggs for processing. Also the empty flats must be gathered or restacked. The present invention provides a novel means for minimizing the labor costs in the transfer of eggs from crates to the loading station.

2. Description of the Prior Art

Devices presently being used in this field require a great amount of manual labor for operation. In particular, normally as the eggs in crates, dollies or other holding or transporting units are received from the farms a laborer will be required to individually load a conveyor. In the normal configuration each flat of eggs contain a six by five array or 30 eggs. These flats are stacked normally six high in egg crates. In order to achieve compact and sturdy packing it is necessary to alternate the orientation of the eggs between adjacent layers of the six total layers within a crate by a 90° rotation thereof. In this manner the total crate height is minimized and the six high stack of egg-filled flat is made more secure. With this configuration the eggs would be oriented five across and six long in certain layers and six across and five long in each alternating layer.

With prior art devices when a stack is uncrated a manual laborer must unstack each flat individually and place it on the conveying means. The individual flats of eggs are then conveyed to the loading station. With the present invention the laborer places the six high stack of egg flats directly on the conveying means such that it is conveyed to the loading station. As such, the eggs are actually directly withdrawn from the uppermost flat of a stack of flats. Therefore with the present system of the present invention individual manual separation of stacks of egg-filled flats is never required. In some prior art devices the stacks of flats are mechanically unstacked and the individual flats are placed on a conveyor to be carried to the egg loading station. Such systems have proven to be less efficient than the system of the present invention in which all the necessary operations on a stack of egg-filled flats take place at a single processing station.

SUMMARY OF THE INVENTION

The present invention provides an apparatus and method for automatically loading eggs directly from stacks of alternately rotatably oriented flats of eggs. The main advantage of the present invention is in the capacity to load eggs directly from stacks of flats rather than individual flats. The eggs are loaded onto a conveyor to be carried to a washer or other similar type device. A stack supply means is included in the form of a conveying means or the like which actually conveys stacks of flats normally being six high to the egg loading station. The first operation on the stack is the removal of eggs by the movement of an egg removal means adjacent to the eggs positioned on the uppermost flat of each stack.

The eggs are removed by normal suction means or other convenient egg removal means.

The apparatus further includes a flat removal means which is positioned adjacent to the loading station and is adapted to remove from each stack of flats the uppermost flat which has just been made empty by the removal of the eggs therein. The flat removal means will normally take the form of a plurality of grippers adapted to bias inwardly against the outer edges of the flat to hold the flat such that it can be removed by the flat removal means and released at a collecting or gathering or restacking location.

Since the alternate flats of each stack are rotated 90° with respect to adjacent flats it is necessary to include a stack rotation means adjacent the loading station which is adapted to rotate each stack of flats approximately 90° after each empty uppermost flat has been removed therefrom. In this manner the uppermost egg-filled flat will be properly oriented with respect to the flat removal means and the egg removal means.

Normally, such flats of eggs have a six by five egg receiving recess array. Since the flats are rotated 90° with respect to the adjacent upper or lower flat therefrom, the arrays on each alternating layer of each stack will be six by five followed by five by six and so forth. Since the egg removal means and flat removal means is preferably maintained in a fixed orientation or array it is necessary that the stack be rotated between the removal of each layer of the stack of egg-filled flats. For this reason a stack rotation means is included which preferably takes the form of a stack lifting device which is positioned immediately below the stack conveying means. This lifting device in combination with the rotation means comprise a total stack orientation device which is capable of placing the uppermost flat and the eggs therein at the proper orientation with respect to the egg removal means and the flat removal means to assure fast and efficient total operation.

In operation the stack orientation device will normally include a platform and a plurality of upwardly extending protruding devices such as balls or the like which will extend into the irregularly shaped undersurface of the lowermost flat of the stack to thereby securely hold the stack of flats during lifting. The orientation device will then lift the flats as well as rotate the flats 90°. The stack when lifted after the removal of the first layer will be lifted high enough such that the position of the uppermost flat and eggs will be at the same height as was the egg-filled flat of the first layer prior to its removal. That is, the lifting means will raise the stack equal in height to the height of the one egg-filled flat which had already been removed. In this manner the eggs and the flat will be at the same location during each repetition of operation of the egg removal means and the flat removal means. Simultaneously, with this lifting or immediately therefore or immediately thereafter the stack will be rotated such that the six by five orientation of the uppermost layer will be made into conformity with the orientation of the suction devices of the egg removing means and the gripping devices of the flat removal means.

The flat removal means will preferably take the form of a plurality of cooperating grippers which may be operated in any fashion but are preferably operated by a plurality of pneumatic powered pistons. In the normal operation it will be desirable to operate the egg removal means and the flat removal means on two stacks of egg-filled flats simultaneously as shown in the figures of the present invention and with such a configuration common pneumatic feedlines to the operating pistons for the adjacently positioned pairs of grippers of the flat removal means will facilitate overall operation of the system.

It is an object of the present invention to provide an apparatus for automatically loading eggs directly from stacks of egg-filled flats.

It is an object of the present invention to provide for automatically loading eggs directly from stacks of alternatingly rotatably oriented flats of eggs.

It is an object of the present invention to provide an apparatus for automatically loading eggs which minimizes the cost of labor activities associated therewith.

It is an object of the present invention to provide a means for directly loading eggs from stacks of flats into a washer device or other similar processing station by rotating and rising the entire stack of eggs as each layer of eggs and empty flats are removed therefrom.

It is an object of the present invention to provide a means for directly loading eggs from stacks of egg-filled flats which is compatible with egg removal equipment of the prior art.

It is an object of the present invention to provide an apparatus for automatically loading eggs directly from stacks of egg-filled flats which includes simultaneously lifting and rotating the stack of eggs in order to place the uppermost flat of eggs in a continuously repeatable orientation with respect to both the egg removing apparatus and the flat removing apparatus.

It is an object of the present invention to provide a method and apparatus for automatically loading eggs directly from stacks of alternately rotatably oriented flats of eggs which includes a flat removal means having a plurality of grippers for grasping empty flats wherein the operation of the grippers is controlled by pneumatically powered pistons.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
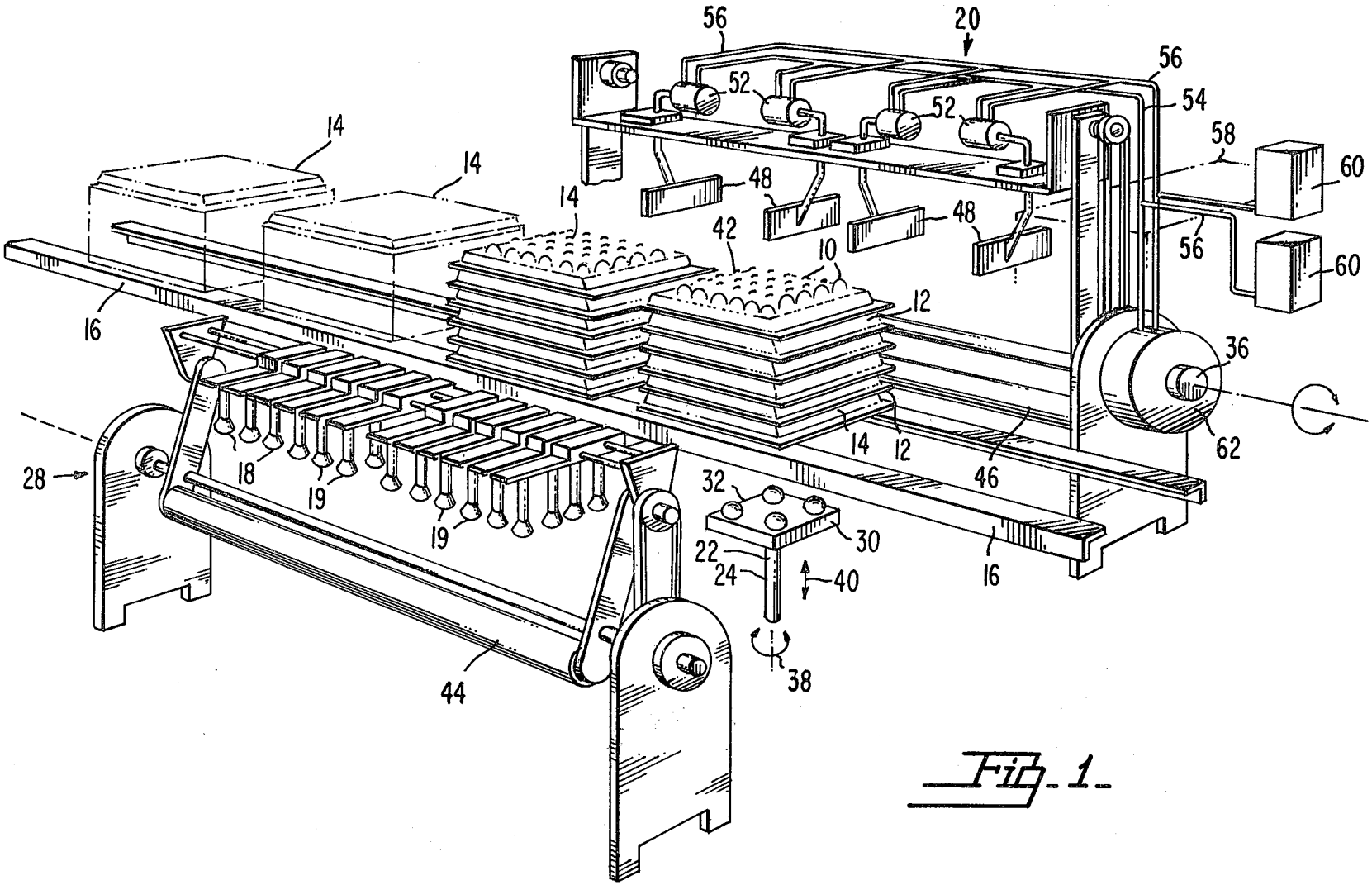
FIG. 1 is a schematic illustration of an embodiment of an apparatus for automatically loading eggs directly from stacks of alternately rotatably oriented flats of eggs.

The present invention provides a means for the loading of eggs 10 from egg flats 12 which are oriented in stacks 14 upon stack supply means 16. A plurality of stacks 14 will be positioned upon the conveying means such as stack supply means 16 to carry the stacks to a loading station 28 to remove the eggs from the flats and to gather the flats.

The loading station 28 will include an egg removal means 18 of any conventional configuration such as one utilizing a plurality of suction means 19. With this configuration the egg removal means 18 will be caused to come in contact with the eggs located in the uppermost flat of a stack 14 and by actuation of the suction will grasp all of the eggs in the six by five array 42 located on each such flat 12. The removal means 18 will then rotate out of contact with the uppermost flat to deposit the eggs on a conveyor means for transfer to a processing station such as an egg washer or the like.

Operation of the egg removal means will include rotation about a drive shaft 64 driven preferably by a gear and chain assembly 66 and 68. This egg removal means is timed to be in coordination with the flat removal means and the stack conveying means to maximize cycles over a given period of time.

The flat removal means 20 is adapted to remove an empty flat 50 after the eggs 10 have been removed therefrom by the egg removal means. In operation the flat removal means 20 will include a plurality of pairs of cooperating grippers 48 which are adapted to grasp the empty uppermost flat on the stack 14. The entire flat removal means assembly 20 will then rotate to remove the flat from the stack and place it upon a convenient collecting means such as a flat collecting conveyor 58. In order to achieve accurate operation of the grippers 48 a plurality of pneumatic pistons 52 will be included and will be powered by pneumatic lines 54 and 56. A pneumatic control means 60 will control the selective operation of the pneumatic pistons to assure proper coordination of closing and opening thereof in response to the position of the flat removal means 20. A main drive means 62 may also be powered by a pneumatic means taken off of the pneumatic power supply through lines 54 and 56 and as such achieve accurate control and operation of rotation of the flat removal means 20 and the gripping means 48.

Figure 2:
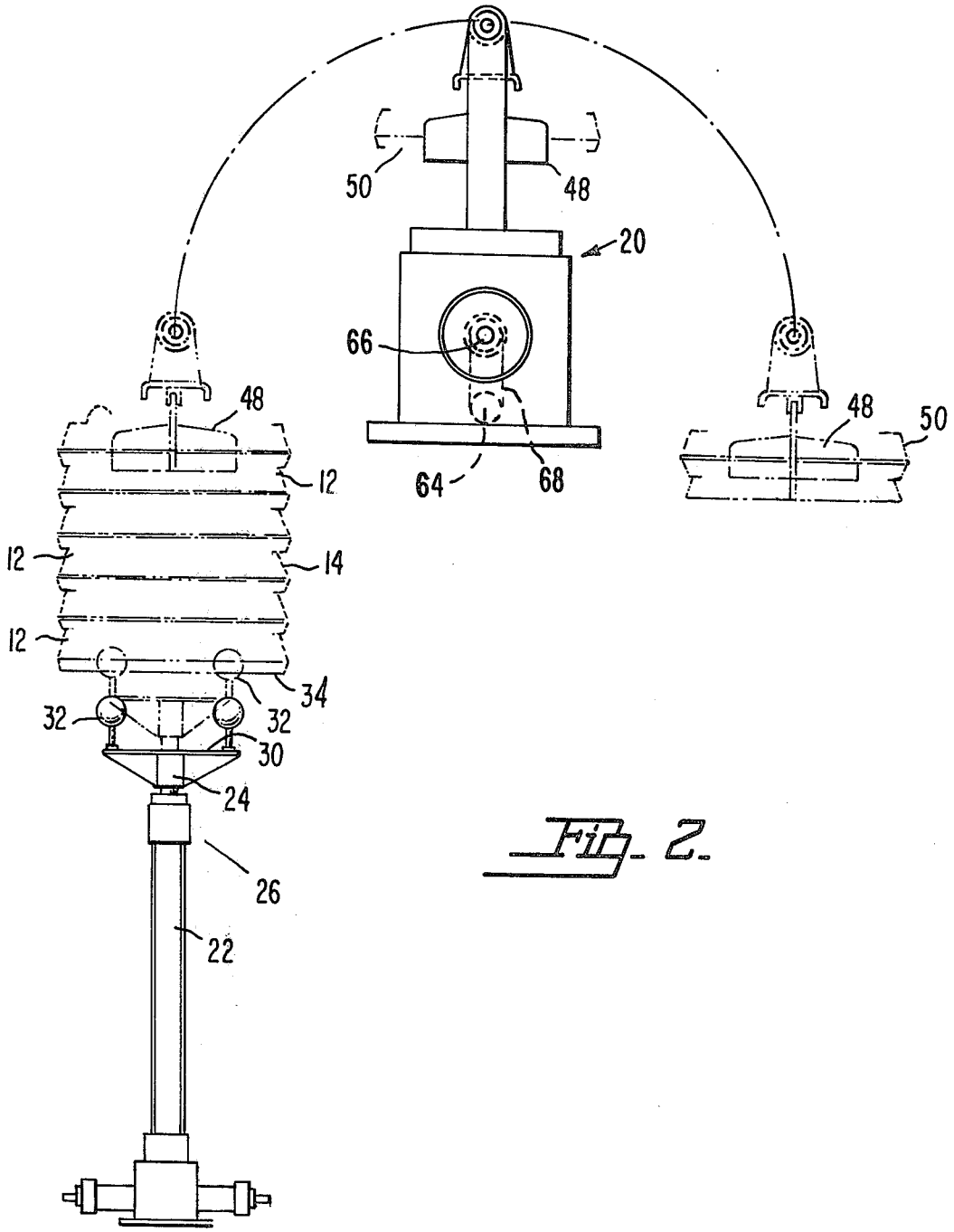
FIG. 2 is a side plan view of an embodiment of the flat removal means of the present invention.
Figure 3:
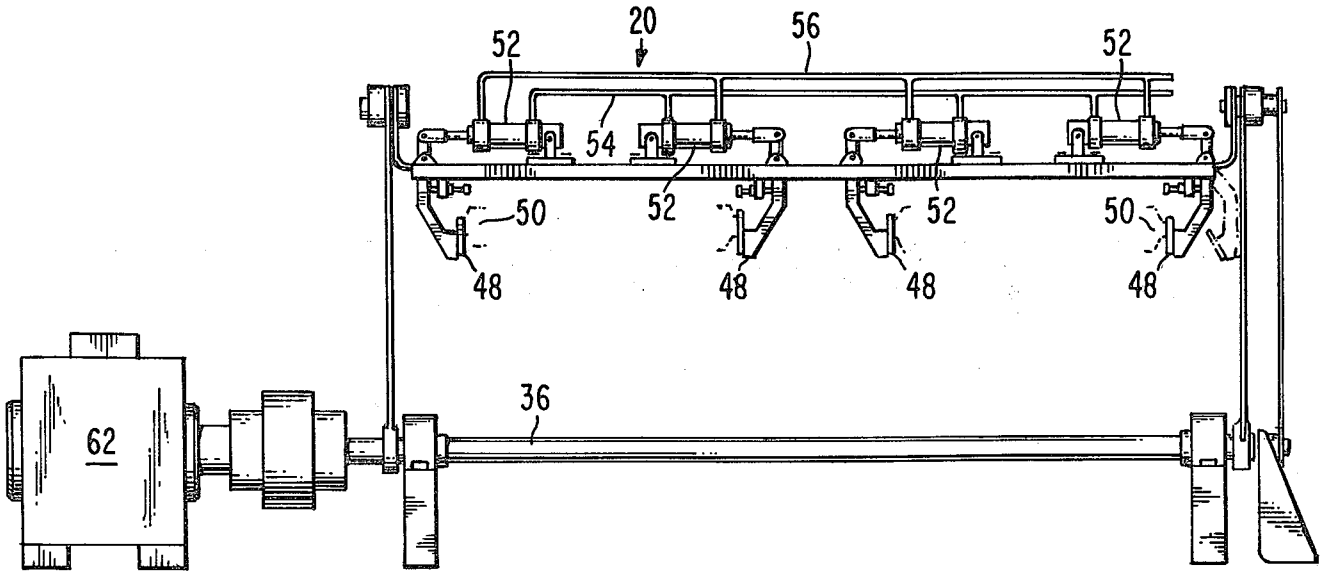
FIG. 3 is a front plan view of an embodiment of the flat removal means of the present invention.

In actual operation the flat removal means 20 will rotate about the drive shaft 36 thereof. When rotated to the forward position as shown in FIG. 1 or to the left position as shown in FIG. 2 the device will be in the position for grasping of the uppermost empty flat 50. In this position the pneumatic control means 60 will pass pneumatic power through line 54 to cause closing of jaws 48 which will thereby allow the flat removal means to grasp the empty flat. Simultaneously the signal in line 54 will cause actuation of main drive means 62 such as to cause rotation of the flat removal means 20 about the drive shaft 36 thereof in the clockwise direction as shown in FIGS. 1 and 2. In this manner the flats will be removed from the top of the stack 14 and will be carried to a flat collecting conveyor 58. Once the grippers 48 are positioned about the conveyor 58 the pneumatic control means 60 will cause pneumatic power to pass through line 56 causing counteractuation of pistons 52 with the resulting release of the flat 12 by gripper 48. To facilitate the balanced operation of the flat removal means 20 a counterweight 46 will be included therein.

In order to enhance packing density and to facilitate stability of stacks of egg-filled flats it is desirable to have each flat rotated 90 degrees with respect to the flat immediately therebelow and immediately thereabove. Therefore each stack will alternatingly be rotated 90 degrees. Also the eggs in the conventionally used flat are arranged in a five by six array as shown at reference numeral 42. It would be unduly expensive and complicated to make machinery which was capable of rotating 90 degrees in between pickup operations for both egg removal and flat removal and therefore the present invention provides a novel means for rotating the actual stack in between pickup operations of egg removal means 18 and flat removal means 20.

Also another problem exists in that both removal means are designed to pick up at a given elevation and as each layer of eggs and as each flat is removed the level changes. Therefore a device is desired in order to lift each time after a removal operation has been completed such that the stack is lifted into an orientation whereby every flat and six by five array of eggs can be removed from the same vertical position.

To achieve this two-fold purpose the present invention provides a stack orientation device comprising a stack lifting means 24 for bringing the eggs or flat to be removed into the proper vertical position as well as a stack rotation means 22 for causing the proper horizontal rotational orientation between the flat and eggs and the respective removal means. To achieve this purpose the present invention includes a lifting platform 30 with a plurality of protruding devices 32 extending upwardly therefrom. These protruding devices 32 are adapted to extend into the irregularly shaped lower surface 34 of the lowermost flat of a stack 14 thereof. In this manner the lifting platform 30 will firmly grab or come in contact with the undersurface of stack 14. Thusly, by rotation of the orientation means 90 degrees and by lifting as required the proper orientation can be maintained. The rotation will be as shown by arrow 38 and the lifting motion will be shown as by arrow 40. It has been shown that the proper timing of motions and balancing of weights is best achieved when a counterweight 44 is included in the egg removal means 18 and a counterweight 46 is included with the flat removal means 20.

In overall operation of this system stack supply means 16 will convey preferably two stacks 14 of filled egg flats 12 into position in the loading station 28. Egg removal means 18 will be rotated into position such that the suction means 19 will contact the six long and five wide array of eggs. The suction means will then be actuated and the eggs will be vacuumed by the egg removal means 18. At this point the removal means will be rotated such that the eggs are carried away from the stack and deposited on a conveyor or other gathering means for the eggs for passage to the next processing station. Simultaneously with the eggs being rotated away from the loading station the flat removal means 20 will be rotated into position by the main drive means 62. This position will be such that the grippers 48 are positioned on opposite sides of that egg flat 12 which was just emptied of eggs 10 by the immediately preceding operation of the egg removal means. At this point the pneumatic control means will cause pneumatic power to be passed into line 54 which will actuate the pistons 52 causing grasping of the uppermost empty flat 50 by grippers 48. The main drive means 62 will then cause clockwise rotation of the flat removal means 20 to allow the empty flat to be released onto the collecting conveyor 58. Release of the empty flats will be achieved by passage of a pneumatic signal into line 56 which will cause deactuation or reverse actuation of the pistons 52 to allow release of the flats by grippers 48. During the removal operation of the empty flats the stack orientation device 26 will be in operation.

This operation will include simultaneous operation of the stack rotation means 22 and the stack lifting means 24. These two devices as shown in FIGS. 1 and 2 are actually a single device which simultaneously lifts and rotates. Actually the rotation could occur after or before or simultaneously with the lifting operation. Since the six by five array of eggs on each flat is alternately rotated at each level therein it is necessary to rotate the eggs 90 degrees. This rotation will be achieved by the placement into contact of the protruding devices 32 with the irregularly shaped undersurface 34 of the lowermost flat of eggs. Also the orientation device 26 will lift the eggs to an elevation such that the new uppermost flat which is filled with eggs will be at the same location as the original uppermost flat was when the stack 14 was still resting upon the conveying means 16. In this configuration the operation of the egg removal means 18 will initiate another cycle of this system which will be repeated until the stack is completely unloaded. At this time the stack supply means 16 will be reactuated and a new pair of stacks will be placed into position within the loading station 28.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. An apparatus for automatically loading eggs directly from stacks of alternately rotatably oriented flats of eggs comprising:

(a) a stack supply means for conveying stacks of egg-filled flats to a loading station;

(b) an egg removal means located adjacent the loading station and adapted to remove eggs from the uppermost flat of each stack of flats;

(c) a flat removal means positioned adjacent the loading station and adapted to remove from each stack of flats an uppermost empty flat after the eggs have been removed therefrom by said egg removal means; and (d) a stack rotation means located adjacent the loading station and adapted to rotate each stack of flats approximately 90° after each empty uppermost flat has been removed to orient the resulting uppermost egg-filled flat with respect to said egg removal means to facilitate removal of eggs therefrom and with respect to said flat removal means to facilitate removal of flats therefrom.

2. The apparatus as defined in claim 1 further comprising a stack lifting means positioned at the loading station adjacent said stack supply means and adapted to selectively lift a stack of egg flats located therein to facilitate removal of eggs by said egg removal means and to facilitate removal of flats by said flat removal means.

3. The apparatus as defined in claim 2 further including a stack orientation device comprising said stack rotation means and said stack lifting means as a single combined integral unit for lifting and rotating each stack after each empty flat is removed therefrom.

4. The apparatus as defined in claim 3 wherein said stack orientation device is positioned below the stacks of flats located on said stack supply means and is adapted to move upwardly to lift and rotate the stack of flats after each empty flat is removed by said flat removal means.

5. The apparatus as defined in claim 4 wherein said stack orientation means initially rotates and then lifts the stack of flats.

6. The apparatus as defined in claim 4 wherein said stack orientation means initially lifts and then rotates the stack of flats.

7. The apparatus as defined in claim 4 wherein said stack orientation means simultaneously rotates and lifts the stack of flats.

8. The apparatus as defined in claim 3 wherein said stack orientation device includes a lifting platform and a plurality of protruding devices extending upwardly therefrom and carried thereon wherein said protruding device extends into the bottom surface of the lowermost flat to secure the stack of flats with respect to said stack orientation device for lifting and rotating thereof.

9. The apparatus as defined in claim 1 wherein said flat removal means comprises a gripper means adapted to grasp an empty flat on opposing sides thereof for lifting and removing from a stack of egg-filled flats.

10. An apparatus for automatically loading eggs directly from stacks of alternately rotatably oriented flats of eggs comprising:

(a) a stack supply means for conveying stacks of egg-filled flats to a loading station;

(b) an egg removal means located adjacent the loading station and adapted to remove eggs from the uppermost flat of each stack of flats;

(c) a flat removal means positioned adjacent the loading station and adapted to remove from each stack of flats an uppermost empty flat after the eggs have been removed therefrom by said egg removal means, said flat removal means further comprising at least one gripper means adapted to grasp an empty flat on opposing sides thereof for lifting and removing from a stack of egg-filled flats; and (d) a stack orientation device for lifting and rotating each stack after each empty flat is removed therefrom, said stack orientation device being positioned below the stacks of flats located on said stack supply means and adapted to move upwardly to lift and rotate the stack of flats after each empty flat is removed by said flat removal means, said stack orientation device including:

1. a stack rotation means located adjacent the loading station and adapted to rotate each stack of flats approximately 90° after each empty uppermost flat has been removed to orient the resulting uppermost egg-filled flat with respect to said egg removal means to facilitate removal of eggs therefrom and with respect to said flat removal means to facilitate removal of flats therefrom;

2. a stack lifting means positioned at the loading station adjacent said stack supply means and adapted to selectively lift a stack of flats located therein to facilitate removal of eggs by said egg removal means and to facilitate removal of flats by said flat removal means;

said stack orientation device further including a lifting platform and a plurality of protruding devices extending upwardly therefrom and carried thereon wherein said protruding device extends into the undersurface of the lowermost flat to secure the stack of flats with respect to said stack orientation device for lifting and rotating therein.

11. A method for automatically loading eggs directly from stacks of alternately rotatably oriented flats of eggs comprising:

(a) conveying a stack of egg-filled flats to a loading station;

(b) continuously unloading of the eggs and flats wherein said unloading includes:

1. removing the eggs from the uppermost flat of the stack of egg-filled flats;

2. removing the empty uppermost flat from the stack of egg-filled flats; and 3. rotating the remaining stack of egg-filled flats approximately 90° to orient the next uppermost flat with respect to the egg removal means and the flat removal means.

12. The method as defined in claim 11 further comprising lifting of the remaining stack of eggs immediately before rotating thereof to facilitate removing of the eggs and of the empty flats therefrom.

13. The method as defined in claim 11 further comprising lifting of the remaining stack of eggs immediately after rotating thereof to facilitate removing of the eggs and of the empty flats therefrom.

14. The method as defined in claim 11 further comprising lifting of the remaining stack of eggs simultaneously with rotating thereof to facilitate removing of the eggs and of the empty flats therefrom.

15. The method as defined in claim 11 wherein said removing of flats includes gripping of the opposite sides thereof.

16. The method as defined in claim 11 wherein said removing of eggs includes suctioning of each egg to selectively affix the egg removal means with respect to the eggs in the uppermost flat.

* * * * *